US011566859B2

(12) United States Patent
Benedini et al.

(10) Patent No.: US 11,566,859 B2
(45) Date of Patent: Jan. 31, 2023

(54) BREECHBLOCK ASSEMBLY FOR A FIREARM AND RELATED FIREARM

(71) Applicant: LEONARDO S.P.A., Rome (IT)

(72) Inventors: Giordano Benedini, La Spezia (IT); Valter Benzoni, La Spezia (IT); Tiziano Bettelli, La Spezia (IT); Stefano Conti, La Spezia (IT); Mattia Forcina, La Spezia (IT); Enrico Sarioli, La Spezia (IT)

(73) Assignee: LEONARDO S.P.A., Rome (IT)

( * ) Notice: Subject to any disclaimer, the term of this patent is extended or adjusted under 35 U.S.C. 154(b) by 0 days.

(21) Appl. No.: 17/433,556

(22) PCT Filed: Feb. 24, 2020

(86) PCT No.: PCT/IB2020/051542

§ 371 (c)(1),
(2) Date: Aug. 24, 2021

(87) PCT Pub. No.: WO2020/174362

PCT Pub. Date: Mar. 9, 2020

(65) Prior Publication Data

US 2022/0146225 A1 May 12, 2022

(30) Foreign Application Priority Data

Feb. 25, 2019 (IT) ..... 102019000002627

(51) Int. Cl.
*F41A 7/10* (2006.01)
*F41A 17/64* (2006.01)

(52) U.S. Cl.
CPC ..... *F41A 7/10* (2013.01); *F41A 17/64* (2013.01)

(58) Field of Classification Search
CPC ..... F41A 7/10; F41A 17/64
(Continued)

(56) References Cited

U.S. PATENT DOCUMENTS 1,216,939 A 2/1917 Beotherston
1,351,017 A * 8/1920 Blackmore ..... F41A 13/04 89/149

(Continued)

FOREIGN PATENT DOCUMENTS

DE 102007048470 A1 4/2009
DE 102009011939 A1 9/2010
DE 102014111165 A1 12/2015

OTHER PUBLICATIONS

International Search Report and Written Opinion for PCT/IB2020/051542 (dated Aug. 21, 2020).

*Primary Examiner* — Bret Hayes
(74) *Attorney, Agent, or Firm* — Merchant & Gould P.C.

(57) ABSTRACT

A breechblock assembly for a firearm includes a guiding element having a slide adapted to slide along a guide in an actuation system of the breechblock assembly driven by a motor. A shutting element shuts an opening in a breech ring of the firearm. A percussion pin is pushed by an elastic element slide along a longitudinal axis, as a function of the firing cycle of the firearm to an axial hole in the shutting element. The percussion pin is shaped to partially come out of the axial hole of the shutting element for firing a piece of ammunition. The breechblock assembly comprises a control system for controlling the percussion pin. The control system controls the operability and the movement of the percussion pin independently of a firing cycle of the firearm.

9 Claims, 5 Drawing Sheets

(58) Field of Classification Search
USPC ..... 89/27.12, 27.3, 28.05, 28.1; 42/69.01, 42/70.08
See application file for complete search history.

(56) References Cited

U.S. PATENT DOCUMENTS

| | | | | | |
|---|---|---|---|---|---|
| 2,466,578 | A * | 4/1949 | Corte | F41A 3/12 | 89/33.16 |
| 3,303,743 | A | 2/1967 | Lanizzani | | |
| 4,141,166 | A * | 2/1979 | Schultz | F41A 17/20 | 42/70.08 |
| 9,841,249 | B1 * | 12/2017 | Nicks | F41A 17/64 | |
| 10,066,892 | B1 * | 9/2018 | Dacier | F41A 9/40 | |

* cited by examiner

BREECHBLOCK ASSEMBLY FOR A FIREARM AND RELATED FIREARM

This application is a National Stage Application of International Application No. PCT/IB2020/051542, filed Feb. 24, 2020, which claims benefit of Ser. No. 102019000002627, filed Feb. 25, 2019, in Italy and which applications are incorporated herein by reference. To the extent appropriate, a claim of priority is made to each of the above-disclosed applications.

The present invention relates to a breechblock assembly capable of carrying out additional functions in a firearm, in particular an automatic firearm, actuated by an actuator, in particular a motor, preferably an electric one.

Furthermore, the present invention relates to a firearm, preferably of the automatic type, more preferably of the type actuated by means of an electric motor.

Actuator assemblies for automatic firearms are known which comprise a percussion pin, which in turn is controlled by an actuator system as a function of the phases of the firing cycle of a firearm. Said actuator system is driven by the continuous motion of a motor, transmitted via suitable mechanisms.

In automatic firearms, therefore, it is not possible to change the operating state of the percussion pin at will, i.e. independently of the firing cycle of the firearm.

The purpose of automatic weapons, of the type actuated by means of an electric motor, is to increase as much as possible the number of pieces of ammunition fired per time unit. In such firearms it is not envisaged to make the actuation of the percussion pin independent of the firing cycle, e.g. in order to make it possible to perfect the aiming of the firearm before firing the piece of ammunition.

The present invention intends to solve these and other technical problems suffered by the prior art by providing an innovative breechblock assembly for firearms, which makes it possible to control the operability and movement of the percussion pin independently of a firing cycle of the firearm.

One aspect of the present invention relates to a breechblock assembly.

A further aspect of the present invention relates to an assembly of a breechblock assembly and an actuation system.

Yet another aspect of the present invention relates to a firearm.

The features and advantages of the breechblock assembly, assembly and firearm will become more apparent in light of the following description of at least one exemplary, but non-limiting, embodiment thereof and of the annexed drawings, wherein.

Figure 1:
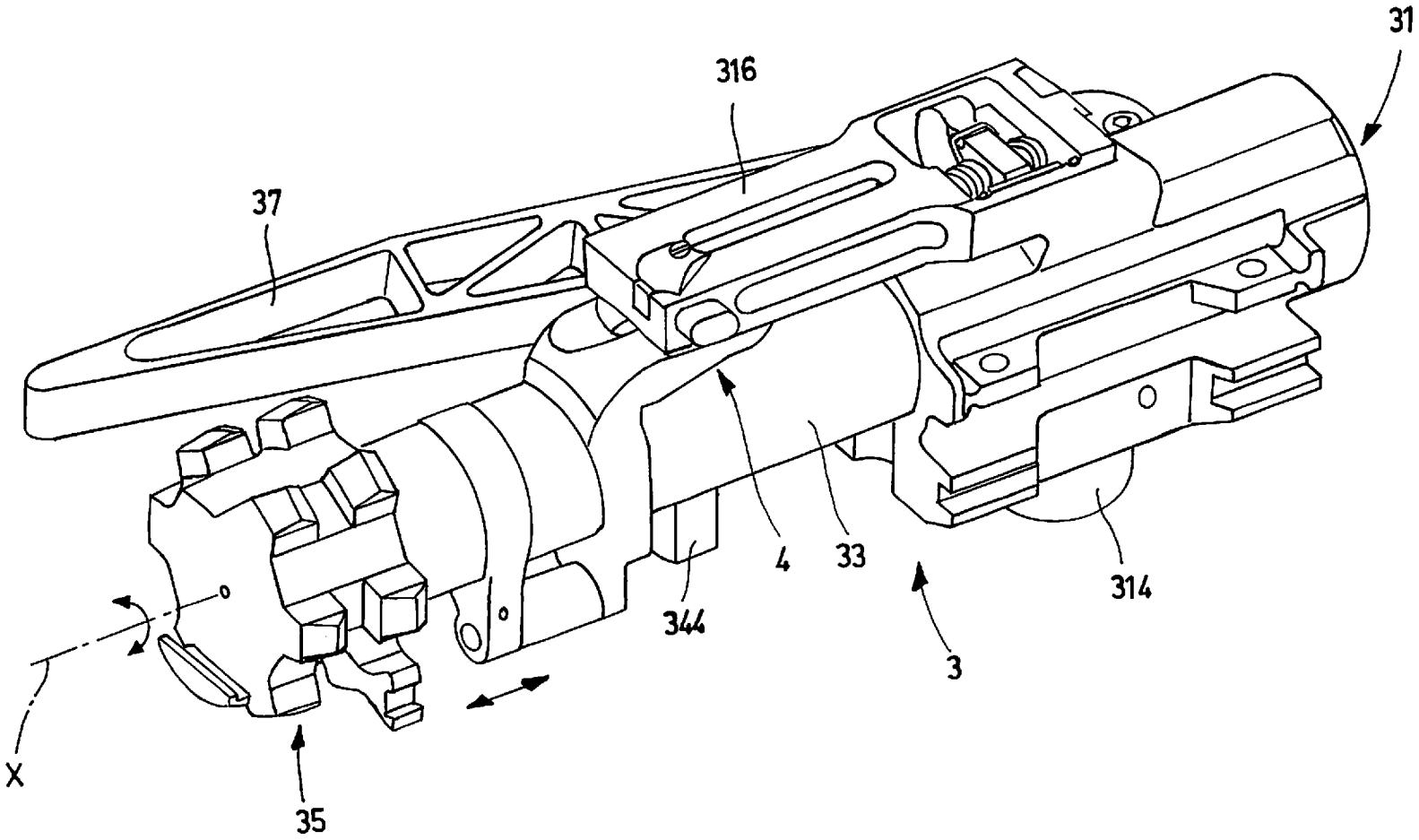
FIG. 1 shows an axonometric view of one possible embodiment of the breechblock assembly according to the present invention.

With reference to the above-mentioned figures, reference numeral 3 designates as a whole the breechblock assembly 3, while reference numeral 1 designates the firearm 1, according to the present invention.

The breechblock assembly 3 according to the present invention is intended for a firearm, preferably an automatic firearm, in particular driven by an electric motor.

Said breechblock assembly 3 according to the present invention comprises a guiding element 31, in turn comprising a slide 314 adapted to slide along a guide 142 comprised in an actuation system 14 of the breechblock assembly 3. Said actuation system 14 is driven, either directly or indirectly, by a motor, preferably an electric motor. More in general, the conformation of said slide 314 will essentially depend on the conformation of the guide 142 of the actuation system 14.

Said breechblock assembly 3 further comprises a shutting element 35. Said shutting element 35 is adapted to shut an opening in a breech ring 12 of the firearm 1.

Said breechblock assembly 3 further comprises a percussion pin 34. Said percussion pin 34 is pushed by an elastic element 332.

More in general, said shutting element 35 comprises an axial hole 352 in which said percussion pin 34 is adapted to slide, as a function of the firing cycle of the firearm 1. Preferably, said axial hole 352 runs along a longitudinal axis "X" of the breechblock assembly 3.

Said percussion pin 34 is adapted to slide along said longitudinal axis "X" as a function of the firing cycle of the firearm 1.

Said percussion pin 34 is so shaped as to be able to partially come out of said axial hole 352 of the shutting element 35 for firing a piece of ammunition.

Said breechblock assembly 3 according to the present invention comprises a control system 4 for controlling the percussion pin 34.

Said control system 4 is adapted to control the operability and the movement of the percussion pin 34 independently of a firing cycle of the firearm 1.

In particular, said control system 4 is adapted to control the operability and the movement of the percussion pin 34 independently of the action of an actuator system 16, which is normally adapted to permit the closing and opening of the breech ring 12 and also the actuation of a percussion pin 34 by acting upon a breechblock assembly 3, in particular by causing it to slide along said longitudinal axis "X".

The present solution makes it possible, therefore, to control in an independent manner the breechblock 34 in a motor-driven automatic firearm 1. For the purposes of the present description, the term "motor-driven automatic firearm" is meant to exclude gas-operated firearms.

More in general, said actuator system 16 is adapted to move said percussion pin 34 of the breechblock assembly 3 in such a way that said percussion pin 34 will take the following operating configurations:

- armed, wherein the percussion pin 34 is away from the piece of ammunition, accumulating potential energy;
- unarmed, wherein the percussion pin 34 is in proximity to the piece of ammunition.

More in general, said control system 4 is capable of controlling the operability and the movement of the percussion pin 34 either in an active manner, by directly moving the percussion pin 34, or in an indirect or passive manner, by selectively preventing the percussion pin 34 from moving.

In a preferred, but non-limiting, embodiment of said breechblock assembly 3, said control system 4 comprises at least one, preferably only one, locking element 42 for locking the percussion pin 34. Preferably, said locking element 42 is adapted to selectively lock said percussion pin 34 from moving, in particular prevent it from moving.

More in general, said locking element 42 is movable. Said locking element 42 can be moved independently of the firing cycle of the firearm 1. In particular, said locking element 42 can be moved independently of the movements made by said actuator system 16 of the firearm 1.

Preferably, said locking element 42 is movable for selectively preventing the movement of said percussion pin 34, for the purpose of independently controlling the percussion pin 34 in a motor-driven automatic firearm, in particular by controlling the operability thereof. Preferably, said locking element 42 directly interferes with said percussion pin 34, preventing it from moving.

In a preferred, but non-limiting, embodiment of the breechblock assembly 3 according to the present invention, said control system 4 is at least partly constrained to the guiding element 31. In the present embodiment, said control system 4 moves integrally with the breechblock assembly 3, thus providing better control over the percussion pin 34.

In an even more preferable embodiment of the breechblock assembly 3 according to the present invention, said guiding element 31 comprises a supporting portion 316. In this embodiment of the breechblock assembly 3, said control system 4 is fixed, at least partly, to said supporting portion 316, preferably in a rigid manner.

More in general, said control system 4 comprises an actuator 41. Said actuator 41 is adapted to control the operability and the movement of the percussion pin 34, whether directly or indirectly.

In a preferred embodiment, said actuator 41 is adapted to move at least one locking element 42. Preferably, said actuator 41 is adapted to move the locking element 42 between:

- a first position of interaction with said percussion pin 34, in which it keeps said percussion pin 34 in an operating, preferably armed, configuration; and
- a second position of release of said percussion pin 34, in which freedom of movement is left to said percussion pin 34.

In the second position of the locking element 42, the movement of the percussion pin 34 is controlled by said actuator system 16.

In the first position of the locking element 42, the percussion pin 34 is locked in a predetermined operating configuration, e.g. armed or unarmed, preferably armed. In such position, the firearm can be correctly aimed at the target before the percussion pin 34 is released for firing the piece of ammunition, independently of the firing cycle of the firearm.

More in general, said actuator 41 is of the electronic and/or mechanical type. In a preferred, but non-limiting, embodiment, said actuator 41 is an electronic one, e.g. comprising an electromagnetic actuator, e.g. a solenoid, adapted to move said locking element 42, the latter being at least partly made of ferromagnetic material.

Preferably, said actuator 41 is adapted to move said locking element 42, causing it to make a linear movement, e.g. along an axis transversal to said longitudinal axis "X".

In one possible embodiment, said actuator 41 can move said locking element 42 in both ways of motion along a straight line. In an alternative embodiment, said actuator is adapted to move said locking element 42 in only one way of motion. In this latter embodiment, said control system 4 comprises an elastic element, e.g. a spring, for repositioning the locking element 42 into a position, preferably the second position, once the action of said actuator 41 has ended. In the present embodiment, said actuator 41 is adapted to bring said locking element 42 into the first position.

More in general, said control system 4 is controlled by means of a control unit, which may either be comprised in the control system 4 itself or belong to a control unit of the firearm 1 in which the breechblock assembly 3 is comprised.

Said control unit is adapted to receive instructions, e.g. through an electronic and/or electromechanical interface with the user of the firearm 1, for appropriately controlling the percussion pin 34.

More in general, said control system 4 performs a function as an additional trigger or actuator system for the firearm 1.

Describing now more in detail further construction aspects of one possible embodiment of the breechblock assembly 3 according to the present invention, said guiding element 31 comprises a housing 312.

Moreover, said breechblock assembly 3 comprises a supporting element 33. Preferably, said supporting element 33 is adapted to be partially inserted into said housing 312 of the guiding element 31. Preferably, said supporting element 33 positions itself coaxial to said housing 312. More preferably, said supporting element 33 is pushed by a second elastic element 32, the latter being situated in said housing 312.

In a preferred embodiment, said percussion pin 34 is adapted to be housed, at least partially, inside said supporting element 33.

Said axial hole 352 of the shutting element 35 is shaped for receiving, at least partially, said supporting element 33. Preferably, said supporting element 33 is coaxial to said axial hole 352. More preferably, said housing 312, said supporting element 33, said percussion pin 34 and said axial hole 352 are coaxial to said longitudinal axis "X".

In a preferred, but non-limiting, embodiment of the breechblock assembly 3 according to the present invention, said guiding element 31, said supporting element 33 and said shutting element 35 are appropriately constrained to one another in such a way that said shutting element 35 and said supporting element 33 are telescopically movable relative to said guiding element 31.

Preferably, said supporting element 33 is adapted to fit into the housing 312 of the guiding element 31. The movement of said supporting element 33 in the housing 312 is countered by said second elastic element 32.

The movement of said supporting element 33 in the housing 312 may be caused, for example, by the recoil that follows the firing of a piece of ammunition.

Preferably, said supporting element 33 is coupled to the guiding element 31 by means of a pin adapted to move in a guide. The coupling is such as to allow the supporting element 33 to move in the housing 312, in particular along said axis "X", within the limits or end-of-travel positions defined by the guide.

Preferably, said supporting element 33 and said shutting element 35 are constrained to each other, preferably in a rigid manner, so that they move integrally as they translate along said longitudinal axis "X". In addition, at least said shutting element 35 is preferably capable of oscillating, making a rotational movement about said longitudinal axis "X", relative to said guiding element 31. Preferably, the rotational movement of the shutting element is such as to provide a shape coupling between said shutting element 35 and the breech ring 12. Preferably, the rotational movement corresponds to a rotation of max. 90° about said longitudinal axis "X". In a preferred embodiment, said supporting element 33 rotates integrally with said shutting element 35 relative to said guiding element 31.

Said percussion pin 34 is housed in said supporting element 33, moving axially along said longitudinal axis "X".

The movement of said percussion pin 34 is countered by the elastic element 332, which is at least partly housed in said supporting element 33.

In a preferred, but non-limiting, embodiment, said guiding element 31 internally houses a base element 321, adapted to define an abutment point for the elastic element 32, adapted to counter the movement of the supporting element 33, and an abutment point for the elastic element 332, adapted to counter the movement of said percussion pin 34.

In a preferred, but non-limiting, embodiment, said percussion pin 34 comprises a punch 342, adapted to abut against the piece of ammunition for the explosion of the same, and a moving element 344, adapted to be driven by the actuator system 16, for moving the percussion pin 34, and in particular the punch 342, between the different operating configurations of the percussion pin 34.

Said punch 342 has a portion of a diameter suitable for it to exit said axial hole 352 of the shutting element 35 for detonating the piece of ammunition located in the breech ring 12.

Said moving element 344 is rigidly constrained to said punch 342, moving integrally therewith.

The control system 4 is preferably adapted to interact with said moving element 344 of the percussion pin 34.

In a preferred embodiment, said moving element 344 has an oblong shape, intersecting said punch 342 along an axis transversal, preferably perpendicular, to said longitudinal axis "X". Preferably, one end of said moving element 344 is adapted to interact with said actuator system 16 of the firearm 1, whereas the opposite end is adapted to interact with said control system 4, in particular with said locking element 42.

In a preferred, but non-limiting, embodiment of the breechblock assembly 3, said supporting portion 316 of the guiding element 31 has an elongate shape, extending from the body of said guiding element 31 parallel to said longitudinal axis "X", and protruding towards said shutting element 35 of the breechblock assembly 3.

In a preferred, but non-limiting, embodiment, said shutting element 35 comprises a protrusion 354.

Preferably, said supporting portion 316 of the guiding element 31 is adapted to interact with said protrusion 354 of the shutting element 35, in particular when a movement of the shutting element 35 and of the supporting element 33 occurs towards the guiding element 31, e.g. after the firing of a piece of ammunition, for the purpose of absorbing part of the recoil.

In a preferred embodiment, said control system 4 is wholly positioned in proximity to the percussion pin 34, and in particular of the moving element 344, being fixed to said supporting portion 316 of the guiding element 31. Preferably, said locking element 42 interacts with the structure of said supporting portion 316 to selectively prevent said percussion pin 34 from moving.

In a preferred, but non-limiting, embodiment, said shutting element 35 further comprises a head 356, adapted to be coupled to said breech ring 12. Preferably, said head 356 comprises at least one, preferably two, rows of teeth or protrusions. Said teeth or protrusions are suitably spaced apart along the circumference of said head 356. Said teeth or protrusions are so shaped as to be able to interact with suitable housings formed in the opening of the breech ring 12 for the insertion of the piece of ammunition.

In the embodiment that comprises more than one rows of teeth, said rows are suitably spaced apart, in particular with respect to said longitudinal axis "X". Preferably, the teeth or protrusions of said rows of teeth are mutually aligned along axes parallel to said longitudinal axis "X".

In a preferred, but non-limiting, embodiment, said shutting element 35 further comprises an interaction portion 358. Said interaction portion 358 is adapted to interact with said actuator system 16 to allow the breech ring 12 to be shut by said shutting element 35, in particular by having said head 356 interact, by shape coupling, with the opening of the breech ring 12, in particular as a consequence of a rotation of said shutting element 35.

The conformation of said interaction portion 358 will depend on the implemented actuator system 16, in particular a first mechanism 162 of the actuator system 16, comprised in the firearm 1.

In a preferred, but non-limiting, embodiment, said breechblock assembly 3 comprises a thrust element 37. Said thrust element 37 is adapted to push the exploded shell case, after firing the piece of ammunition, towards a case discharge channel comprised in the firearm 1.

In particular, said thrust element 37 is adapted to push said shell case while the breechblock assembly 3 is being moved for pressing a new piece of ammunition into the breech ring 12.

Said thrust element 37 may be a distinct element, preferably fixed to the guiding element 31. As an alternative, said thrust element 37 is made as one piece with said guiding element 31.

Preferably, the design of said thrust element 37 minimizes weight while preserving an adequate degree of stiffness, featuring, for example, a reticulate, e.g. lattice, conformation.

A further aspect of the present invention relates to an assembly comprising: a breechblock assembly 3, according to the present invention, and an actuation system 14 for said breechblock assembly 3. Said actuation system 14 is adapted to move said breechblock assembly 3 into different positions, as a function of the firing phases of a firearm 1.

In a preferred, but non-limiting, embodiment of the assembly according to the present invention, said actuation system 14 comprises a drum-type cylindrical cam 141. Said cylindrical cam 141 is adapted to move the slide 314 comprised in said breechblock assembly 3. In particular, said cylindrical cam 141 comprises a guide 142 along which said slide 314 can slide. In a preferred, but non-limiting, embodiment, said cylindrical cam 141 is a multi-revolution cam.

More in general, said cylindrical cam 141 is configured to be rotatably actuated about an axis by a motor. Preferably, the cylindrical cam 141 is configured to be rotatably driven by the motor in the clockwise direction, in particular when viewing the cylindrical cam 141 from the rear, i.e. from the side opposite to the breech ring 12 and the barrel 13, which are situated ahead of said cylindrical cam 141.

The cylindrical cam 141 co-operates with the slide 314 for controlling the movement of the breechblock assembly 3 along said guide 142 between a first operating position and a second operating position.

Said guide 142 preferably comprises a first parking section, where the breechblock assembly 3 is kept in said first operating position, and where said breechblock assembly 3 is in a position remote from said breech ring 12 and allows the extraction of the shell case and the insertion of a new piece of ammunition, and a second parking section, where said breechblock assembly 3 is kept in said second operating position, and where said breechblock assembly 3 is proximal to said breech ring 12 and can co-operate with said breech ring 12 for the phases of firing a piece of ammunition, in particular by co-operating with said actuator system 16 for moving both the percussion pin 34 and the shutting element 35.

Said guide 142 further comprises a forward intermediate section and a backward intermediate section connecting said first parking section and said second parking section, and wherein said breechblock assembly 3 is moved forward from said first operating position to said second operating position and, respectively, backward from said second operating position to said first operating position.

In a preferred embodiment, the cylindrical cam 141 is a positive-control cam.

In a preferred, but non-limiting, embodiment of the assembly according to the present invention, said assembly also includes an actuator system 16. Said actuator system 16 is adapted to interact with the breechblock assembly 3 to allow closing the breech ring 12 and firing the piece of ammunition.

Preferably, said cylindrical cam 141 of the actuation system 14 is coupled to the actuator system 16 by means of a shaft.

A preferred embodiment of the actuator system 16 comprises: a first mechanism 162, which is adapted to allow closing and opening a breech ring 12, in particular by acting upon the shutting element 35 of the breechblock assembly 3. Furthermore, said actuator system 16 comprises a second mechanism 164, which is adapted to permit the actuation of the percussion pin 34 of the breechblock assembly 3 as a function of the firing phases of a firearm 1.

In one possible embodiment of said actuator system 16, said first mechanism 162 comprises cam mechanisms. Preferably, also said second mechanism 164 comprises cam mechanisms. Said cam mechanisms are preferably face cams.

In a preferred, but non-limiting, embodiment, said actuator system 16 comprises a cylindrical element in which the face cam of said first mechanism 162 lies on a first face of the cylindrical element; whereas the face cam of the second mechanism 164 lies on a second face of the same cylindrical element. Preferably, said cylindrical element is mounted idle, on suitable bearings, to the structure of the breech ring 12, under the opening of the breech ring 12 into which the piece of ammunition is pressed.

The control system 4 according to the present invention makes it possible to decouple the breechblock assembly 3 from the action of the actuator system 16 of the assembly, thereby providing control over the instant of the firing of the piece of ammunition located in the breech ring 12 independently of the firing cycle of the firearm 1.

Finally, a further aspect of the present invention relates to a firearm 1. The firearm 1 according to the present invention is an automatic firearm controlled by a motor (not shown). The firearm 1 comprises a recoiling mass, in turn comprising: a breech ring 12; a barrel 13; a braking system 15, the latter adapted to suitably brake the recoiling motion of the same recoiling mass of the firearm 1.

Said firearm 1 further comprises an actuator system 16. In a preferred, but non-limiting, embodiment, said actuator system 16 of the firearm 1 moves integrally with said recoiling mass.

Said firearm 1 according to the present invention further comprises: a breechblock assembly 3, which is adapted to connect to the breech ring 12 to allow firing the piece of ammunition; and an actuation system 14 for said breechblock assembly 3. Said actuation system 14 is adapted to move said breechblock assembly 3 into different positions, as a function of the firing phases of the firearm 1.

The firearm 1 according to the present invention is, for example, a single-barrel firearm and, preferably, said breech ring 12 is configured to receive a shell, e.g. a thirty-millimeter (30 mm) caliber shell, to be fired.

Figure 5:
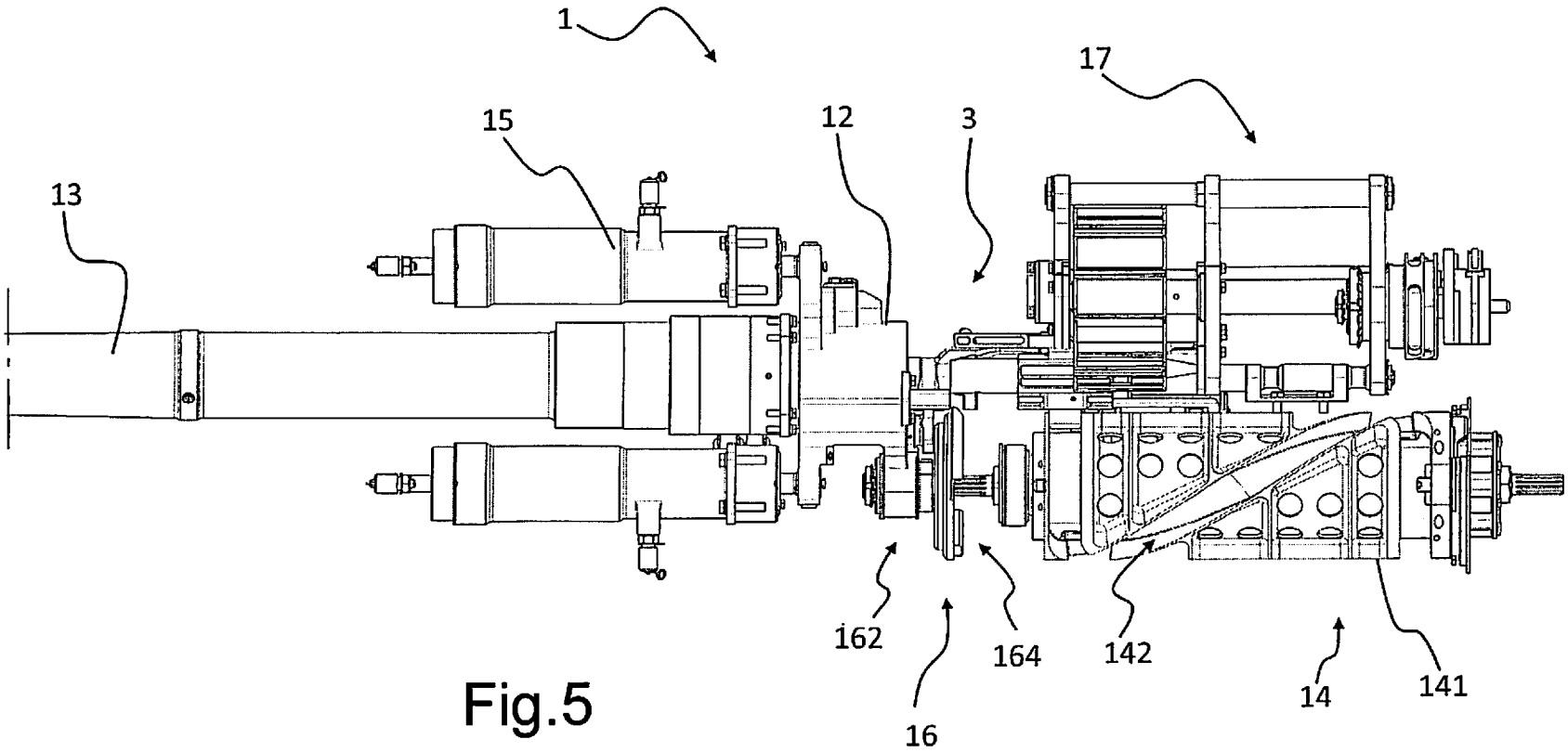
FIG. 5 shows a side view of a firearm according to one possible exemplary, but non-limiting, embodiment, wherein the firearm comprises a breechblock assembly according to the present invention.

One possible exemplary, but non-limiting, embodiment is illustrated, by way of example, in FIG. 5.

FIG. 5 shows a firearm 1 comprising a breechblock assembly 3 according to the present invention.

The figure also shows an actuation system 14 comprising a cylindrical cam 141, defining a guide 142 on its outer periphery, adapted to move the breechblock assembly 3.

When viewing the figure one can see that on top of the cylindrical cam 141 there is an ammunition moving system 17, which comprises an intermitter system for properly moving the ammunition as a function of the position of the breechblock assembly 3.

In the illustrated embodiment, said cylindrical cam 141 is coupled, through a shaft, to the actuator system 16, which comprises a first mechanism 162 and a second mechanism 164 at both ends of a cylindrical element mounted idle and driven by said shaft connected to the cylindrical cam 141.

In the illustrated embodiment, the breechblock assembly 3 has completed the pressing of the piece of ammunition into the breech ring 12.

The figure shows some possible embodiments of the barrel 13 and of the braking system 15.

Figure 4:
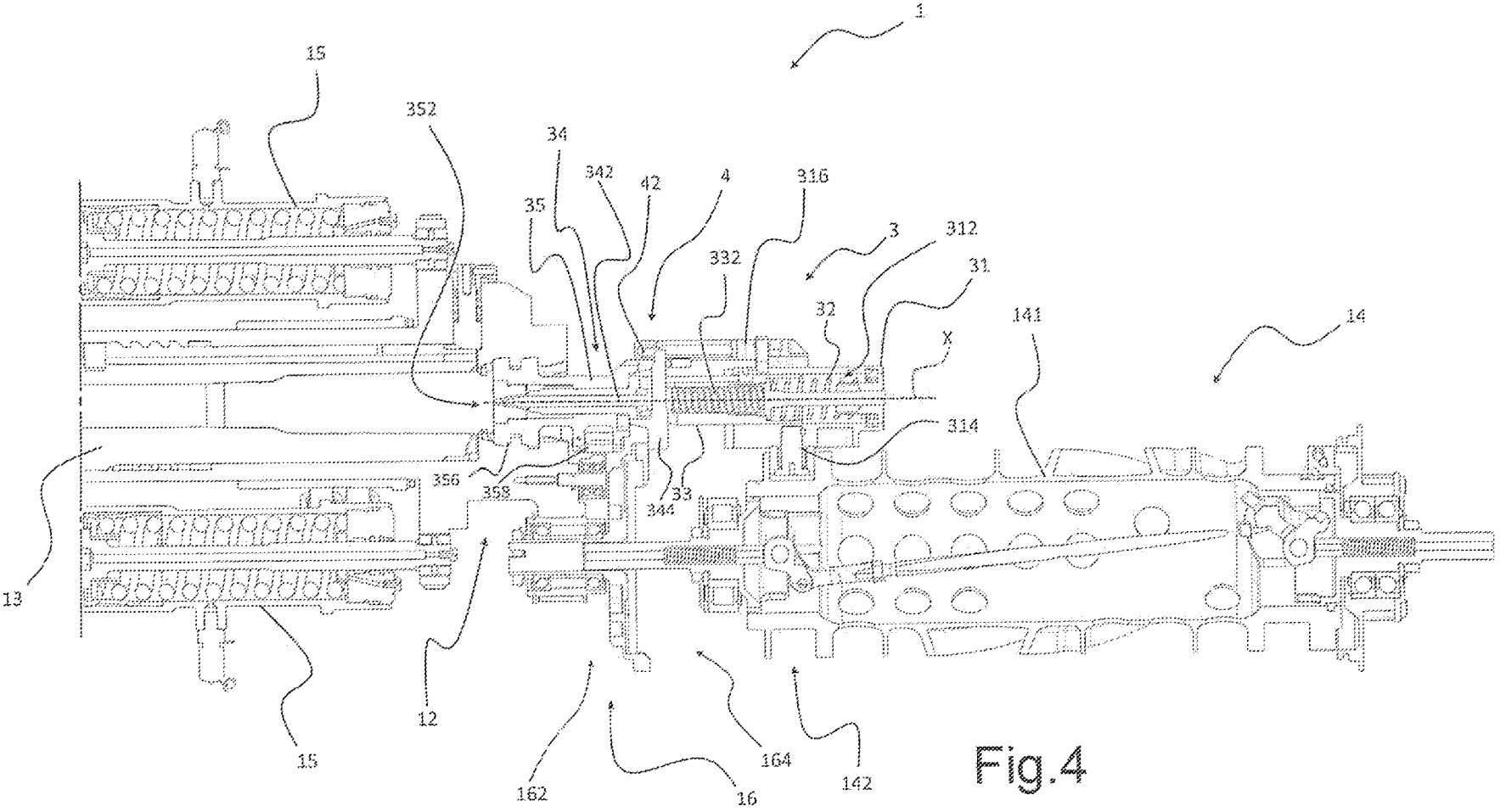
FIG. 4 shows a sectional view relative to a vertical plane of a preferred embodiment of an assembly of a breechblock assembly and an actuation system during a phase of the firing cycle, in particular preceding the firing of the piece of ammunition.

FIG. 4 shows a sectional view relative to a vertical plane of the assembly the breechblock assembly 3, the actuation system 14 and the actuator system 16 in a phase of the firing cycle that precedes the firing of the piece of ammunition.

In this figure one can see further construction details of the cylindrical cam 141 of the actuation system 14, as well as of the first mechanism 162 and second mechanism 164 of the actuator system 16. FIG. 4 also shows further construction details of the barrel 13 and of the braking system 15.

In addition, FIG. 4 shows some possible construction details of a preferred embodiment of the breechblock assembly 3 according to the present invention.

FIG. 1 shows an axonometric view of a preferred, but non-limiting, embodiment of the breechblock assembly 3 according to the present invention in the assembled condition.

FIG. 1 illustrates the external shapes of the various elements comprised in the breechblock assembly 3 according to the present invention. In particular, FIG. 1 shows one possible embodiment of the guiding element 31, with the associated slide 314 and the supporting portion 316.

FIG. 1 illustrates the supporting element 33 and an embodiment of the thrust element 37.

FIG. 1 also shows the position of the control system 4 in one possible embodiment of the breechblock assembly 3.

In this figure one can also see the outer profile of the shutting element 35 adapted to be suitably coupled to the breech ring 12. The figure also shows a part of the moving element 344 of the percussion pin 34.

Figure 2:
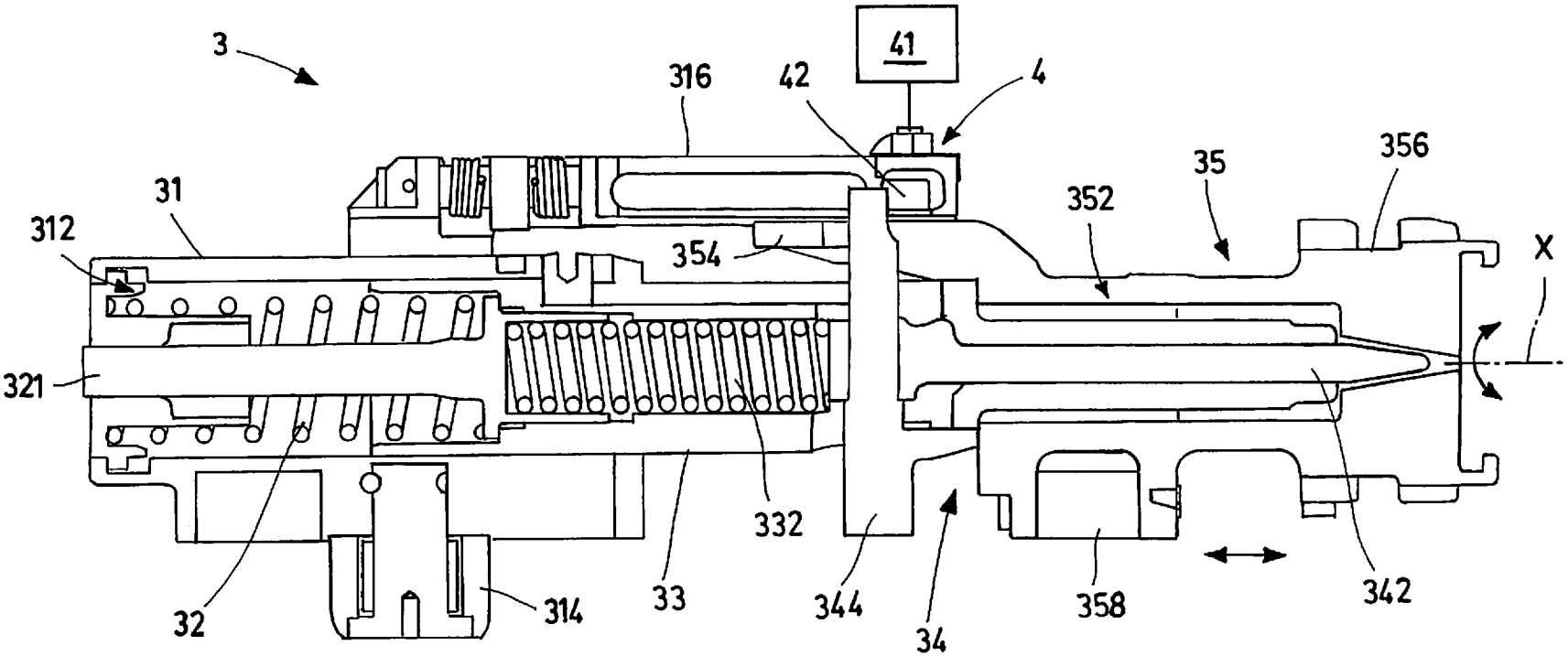
FIG. 2 shows a sectional view relative to a vertical plane of the breechblock assembly of FIG. 1, according to the present invention.

FIG. 2 shows a sectional view relative to a vertical plane of the breechblock assembly 3, according to the present invention.

In the illustrated embodiment, one can see a possible conformation and disposition of the guiding element 31 and base element 321. From this figure one can understand that the supporting element 33 and the shutting element 35 are telescopically movable relative to said guiding element 31, opposed by the elastic element 32.

FIG. 2 shows the coaxial arrangement of the supporting element 33, the elastic element 332, the percussion pin 34, and in particular the punch 342, and the shutting element 35.

From FIG. 2 one can also understand the interaction between the supporting portion 316 of the guiding element 31 and the protrusion 354 of the shutting element 35.

FIG. 2 also shows the possible disposition of the locking element 42 of the control system 4. The actuator 41 is schematically represented as a block to indicate that its position may be either proximal to or remote from the locking element 42. The figure also shows the interaction between the locking element 42 of the control system 4 and the moving element 344 of the percussion pin 34, for the purpose of controlling the movement of the percussion pin 34 independently of the firing cycle of the firearm 1.

In the figure it is visible that the punch 342 is configured to come out of the axial hole 352 in order to hit the piece of ammunition and cause the firing thereof. In the figure one can also see one possible embodiment of the interaction portion 358 adapted to interact with the first mechanism 162 of the actuator system 16.

Figure 3C:
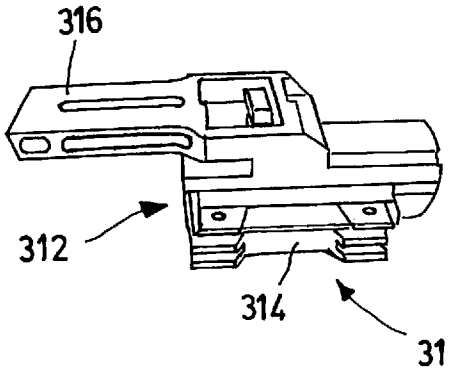
FIGS. 3A-3C show perspective views of some parts, illustrated individually, of one possible embodiment of the breechblock assembly according to the present invention.
Figure 3B:
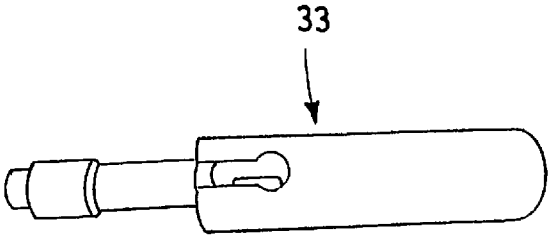
Figure 3A:
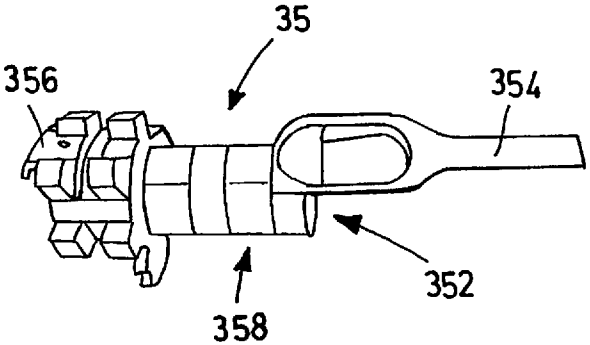

FIG. 3A shows a preferred embodiment of the shutting element 35, wherein one can see, in a perspective view, the construction details of the head 356 and of the protrusion 354. Moreover, FIG. 3A indicates the position of both the axial hole 352 and the interaction portion 358.

FIG. 3B shows one possible embodiment of the supporting element, wherein further construction details are visible.

Finally, FIG. 3C shows one possible embodiment of the guiding element 31, wherein the construction details of the supporting portion 316 are visible. FIG. 3C also indicates the positioning of the housing 312 and of the slide 314.

Any embodiments of the breechblock assembly 3 which have not been illustrated or described herein, but which can be easily inferred by a person skilled in the art in the light of the contents of the present patent application, shall fall within the scope of the present invention.

REFERENCE NUMERALS

Firearm 1
Breech ring 12
Barrel 13
Actuation system 14
Cylindrical cam 141
Guide 142
Braking system 15
Actuator system 16
First mechanism 162
Second mechanism 164
Moving system 17
Breechblock assembly 3
Guiding element 31
Housing 312
Slide 314
Supporting portion 316
Elastic element 32
Base element 321
Supporting element 33
Elastic element 332
Percussion pin 34
Punch 342
Moving element 344
Shutting element 35
Axial hole 352
Protrusion 354
Head 356
Interaction portion 358
Thrust element 37
Control system 4
Actuator 41
Locking element 42
Longitudinal axis "X"

The invention claimed is:

1. A breechblock assembly for a firearm, comprising:

a guiding element comprising, a slide adapted to slide along a guide comprised in an actuation system of the breechblock assembly driven by a motor;

a shutting element, adapted to shut an opening in a breech ring of the firearm;

a percussion pin, which is pushed by an elastic element; said shutting element comprising an axial hole in which said percussion pin is adapted to slide along a longitudinal axis, as a function of a firing cycle of the firearm with which said breechblock assembly is associated;

said percussion pin being shaped to partially come out of said axial hole of the shutting element for firing a piece of ammunition;

said breechblock assembly comprising a control system for controlling the percussion pin;

said control system being adapted to control prevention of movement of the percussion pin independently of the firing cycle of the firearm;

wherein said guiding element comprises a supporting portion;

wherein said control system is constrained to said element and fixed to said supporting portion.

2. The breechblock assembly according to claim 1, wherein said control system comprises at least one locking element for locking the percussion pin;

said locking element being movable independently of the firing cycle of the firearm.

3. The breechblock assembly according to claim 1, wherein said control system comprises an actuator adapted to move at least one locking element between: a first position of interaction with said percussion pin, in which said at least one locking element keeps said percussion pin in an armed operating configuration; and a second position of release of said percussion pin, in which freedom of movement is left to said percussion pin.

4. The breechblock assembly according to claim 1, wherein:

said guiding element comprises a housing;

said breechblock assembly comprising a supporting element adapted to be partially inserted into said housing of the guiding element, positioning said supporting element coaxial to said housing;

said supporting element being pushed by a second elastic element;

said percussion pin being adapted to be housed, at least partially, inside said supporting element;

said axial hole being shaped for receiving, at least partially, said supporting element;

said guiding element, said supporting element and said shutting element being constrained to one another so that said shutting element and said supporting element are telescopically movable relative to said guiding element.

5. An assembly comprising:

the breechblock assembly according to claim 1;

the actuation system for said breechblock assembly, adapted to move said breechblock assembly into different positions, as a function of firing phases of the firearm.

6. The assembly according to claim 5, wherein said actuation system comprises a drum shaped cylindrical cam adapted to move the slide in said breechblock assembly.

7. The assembly according to claim 5, comprising the actuation system comprising:

a first mechanism adapted to allow closing and opening the breech ring by acting upon the shutting element of the breechblock assembly;

a second mechanism adapted to allow actuating the percussion pin of the breechblock assembly as a function of firing phases of the firearm.

8. A firearm comprising:

a recoiling mass; comprising:

a breech ring;

a barrel;

a braking system adapted to brake recoiling motion of a recoiling mass of the firearm;

an actuator system for actuating the firearm, moving integrally with said recoiling mass;

a breechblock assembly, comprising:

a guiding element comprising, a slide adapted to slide along a guide comprised in an actuation system of the breechblock assembly driven by a motor;

a shutting element, adapted to shut an opening in the breech ring of the firearm;

a percussion pin, which is pushed by an elastic element;

said shutting element comprising an axial hole in which said percussion pin is adapted to slide along a longitudinal axis, as a function of a firing cycle of the firearm with which said breechblock assembly is associated;

said percussion pin being shaped to partially come out of said axial hole of the shutting element for firing a piece of ammunition;

said breechblock assembly comprising a control system for controlling the percussion pin;

said control system being adapted to control prevention of movement of the percussion pin independently of the firing cycle of the firearm;

the breechblock assembly adapted to connect to the breech ring to allow firing the piece of ammunition;

an actuation system for said breechblock assembly, adapted to move said breechblock assembly into different positions, as a function of firing phases of the firearm.

9. A breechblock assembly for a firearm, comprising:

a guiding element comprising, a slide adapted to slide along a guide comprised in an actuation system of the breechblock assembly driven by a motor;

a shutting element, adapted to shut an opening in a breech ring of the firearm;

a percussion pin, which is pushed by an elastic element;

said shutting element comprising an axial hole in which said percussion pin is adapted to slide along a longitudinal axis, as a function of a firing cycle of the firearm with which said breechblock assembly is associated;

said percussion pin being shaped to partially come out of said axial hole of the shutting element for firing a piece of ammunition;

said breechblock assembly comprising a control system for controlling the percussion pin;

said control system being adapted to control prevention of movement of the percussion pin independently of the firing cycle of the firearm;

wherein:

said guiding element comprises a housing;

said breechblock assembly comprising a supporting element adapted to be partially inserted into said housing of the guiding element, positioning said supporting element coaxial to said housing;

said supporting element being pushed by a second elastic element;

said percussion pin being adapted to be housed, at least partially, inside said supporting element;

said axial hole being shaped for receiving, at least partially, said supporting element;

said guiding element, said supporting element and said shutting element being constrained to one another so that said shutting element and said supporting element are telescopically movable relative to said guiding element.

* * * * *